US008490276B2

(12) United States Patent
Julian

(10) Patent No.: US 8,490,276 B2
(45) Date of Patent: Jul. 23, 2013

(54) APPARATUS AND METHOD FOR MOUNTING A PLUMBING FIXTURE

(76) Inventor: Brian Julian, Columbus, OH (US)

( * ) Notice: Subject to any disclaimer, the term of this patent is extended or adjusted under 35 U.S.C. 154(b) by 264 days.

(21) Appl. No.: 13/040,802

(22) Filed: Mar. 4, 2011

(65) Prior Publication Data

US 2012/0047713 A1 Mar. 1, 2012

Related U.S. Application Data

(63) Continuation-in-part of application No. PCT/US2009/055994, filed on Sep. 4, 2009.

(60) Provisional application No. 61/190,930, filed on Sep. 4, 2008.

(51) Int. Cl.
*E03C 1/04* (2006.01)

(52) U.S. Cl.
USPC ..... 29/525.01; 4/695; 29/282; 285/64

(58) Field of Classification Search
USPC ..... 29/525.01, 525.11, 282; 4/695; 285/64
See application file for complete search history.

(56) References Cited

U.S. PATENT DOCUMENTS

| | | | | |
|---|---|---|---|---|
| 4,281,857 | A * | 8/1981 | Randall | 285/34 |
| 6,301,728 | B1 * | 10/2001 | Pilatowicz et al. | 4/695 |
| 2012/0110826 | A1 * | 5/2012 | Reiman et al. | 29/525.11 |

FOREIGN PATENT DOCUMENTS

| | | |
|---|---|---|
| JP | 13140307 | 5/2001 |
| KR | 19980025063 | 7/1998 |
| KR | 200395251 | 9/2005 |
| WO | WO03/010392 | 2/2003 |

* cited by examiner

*Primary Examiner* — Alexander P Taousakis
(74) *Attorney, Agent, or Firm* — Standley Law Group LLP

(57) ABSTRACT

A device for mounting of a plumbing fixture such as a faucet or the like through a hole in a counter, a sink or the like and connection of the fixture to a supply line. A collar member of the device is slidingly retained on an inlet tube of the fixture by a connecting nut of the supply line. A rod, guided in its axial movement by a guide member that is connected to the collar member, has a flag member that is rotatable between a stowed position and a deployed position. In the stowed position, the device may be passed through the hole when connected to the plumbing fixture and the supply line. In the deployed position, the flag member increases the axial profile of the device and co-acts with the body of the plumbing fixture in retaining the plumbing fixture in the hole.

13 Claims, 15 Drawing Sheets

APPARATUS AND METHOD FOR MOUNTING A PLUMBING FIXTURE

CROSS-REFERENCE TO RELATED APPLICATIONS

This application is a continuation-in-part of, and claims a right of priority from, PCT/US2009/055994, filed 4 Sep. 2009, which is, in turn, a non-provisional of, and claims a right of priority from U.S. 61/190,930, filed 4 Sep. 2008. The content of both applications are incorporated by reference as if fully recited herein.

TECHNICAL FIELD

The disclosed embodiments relate to a device which assists in the mounting of a plumbing fixture such as a faucet through a surface such as a counter top.

BACKGROUND OF THE ART

The mounting a faucet on a counter is conventionally accomplished by inserting the water inlet tube of the faucet down through a small hole in a counter to seat the faucet trim plate on the counter top. Next, a clamping nut is manually turned to advance along the tube until it engages the counter bottom and pulls the trim plate snugly against the counter top to clamp the faucet to the counter. Then the inlet tube is connected to a water supply line by tightening a mounting nut. Note how all of these steps are required to be accomplished under the counter, in a space that is almost always a confined space. To remove the faucet, the cumbersome process must be repeated in reverse, with the same shortcomings, although the rusted components often exacerbate the process.

A number of US patents have attempted to address this problem, but these attempts inevitably remain located below the counter, and they have not provided, to the inventor's knowledge, a commercially viable system. They have also failed to provide a system that can be used with the generic faucet fixture, as they require a proprietary faucet fixture, even though the lines that supply water to the faucets are almost completely standardized. This limits the ability of the plumber or homeowner to avail themselves of the improvement in some of those patents in doing a retrofit.

A need exists to provide a simple, inexpensive and effective device or method of installing a faucet that is also effective for easily removing and replacing the faucet.

SUMMARY

This object and others are achieved by a device comprising a collar member, a guide member, a rod and a flag member. The collar member is sized to be slidingly received on the inlet tube and is retained thereon when the supply line connecting nut engages the inlet tube. The internally-threaded guide member is connected to the collar member. The rod is threaded externally with threading that is complementary to the internal threading of the guide member. The rod has an enlarged stop at its first end. The flag member has a body with a sleeve along one side thereof, the sleeve sized such that the flag member is slidingly received on the rod and restrained from axial movement thereon near the enlarged stop. The flag member is selectively rotatable about the rod between a stowed position and a deployed position.

The device is useful for mounting a faucet, especially to a counter.

In some embodiments, a thumb screw head at a second end of the rod facilitates manual rotation of the rod in the guide member.

In some embodiments, the flag member is a generally rectangular section of an annular ring with a radius of curvature that proximates the radius of the inlet tube, allowing the flag member to align closely with the inlet tube when in the stowed position. In other embodiments, the body of the flag member comprises a first and a second body member, hingedly connected to each other along the side having the sleeve, with the body members in closed hinged relation to each other in the stowed position and in open hinged relation to each other in the deployed position. In this latter embodiment, the first and second body members can be perpendicular to each other about the hinge, when in the deployed position.

Some objects of the inventive concept are achieved by a method for mounting and connecting a plumbing fixture on a first side of a surface to a supply line on a second side of the surface through a hole in the surface, the plumbing fixture comprising a fixture body with an inlet tube sized and adapted for threading engagement to a connecting nut at an end of the supply line. The method comprising the steps of: providing a mounting device as described above; passing the connecting nut end of the supply line through the hole from the second side of the surface to the first side; engaging the connecting nut to the inlet tube, while the mounting device is also passing through the hole from the second side to the first side and the collar member is received on the inlet tube, forming a connected plumbing fixture; passing the inlet line of the connected plumbing fixture through the hole from the first side to the second side, with the flag member of the mounting device passing through the hole in the stowed position, resulting with the fixture body positioned atop the hole on the first side of the surface; and securing the connected plumbing fixture to the surface, the fixture body limiting movement through the hole in a first direction and the flag member, in the deployed position, limiting movement through the hole in an opposite second direction.

BRIEF DESCRIPTION OF THE DRAWINGS

These advantages of the inventive concept will be best understood by referring the accompanying drawings, wherein identical parts are identified by identical reference numerals and wherein.

DETAILED DESCRIPTION

Figure 1:
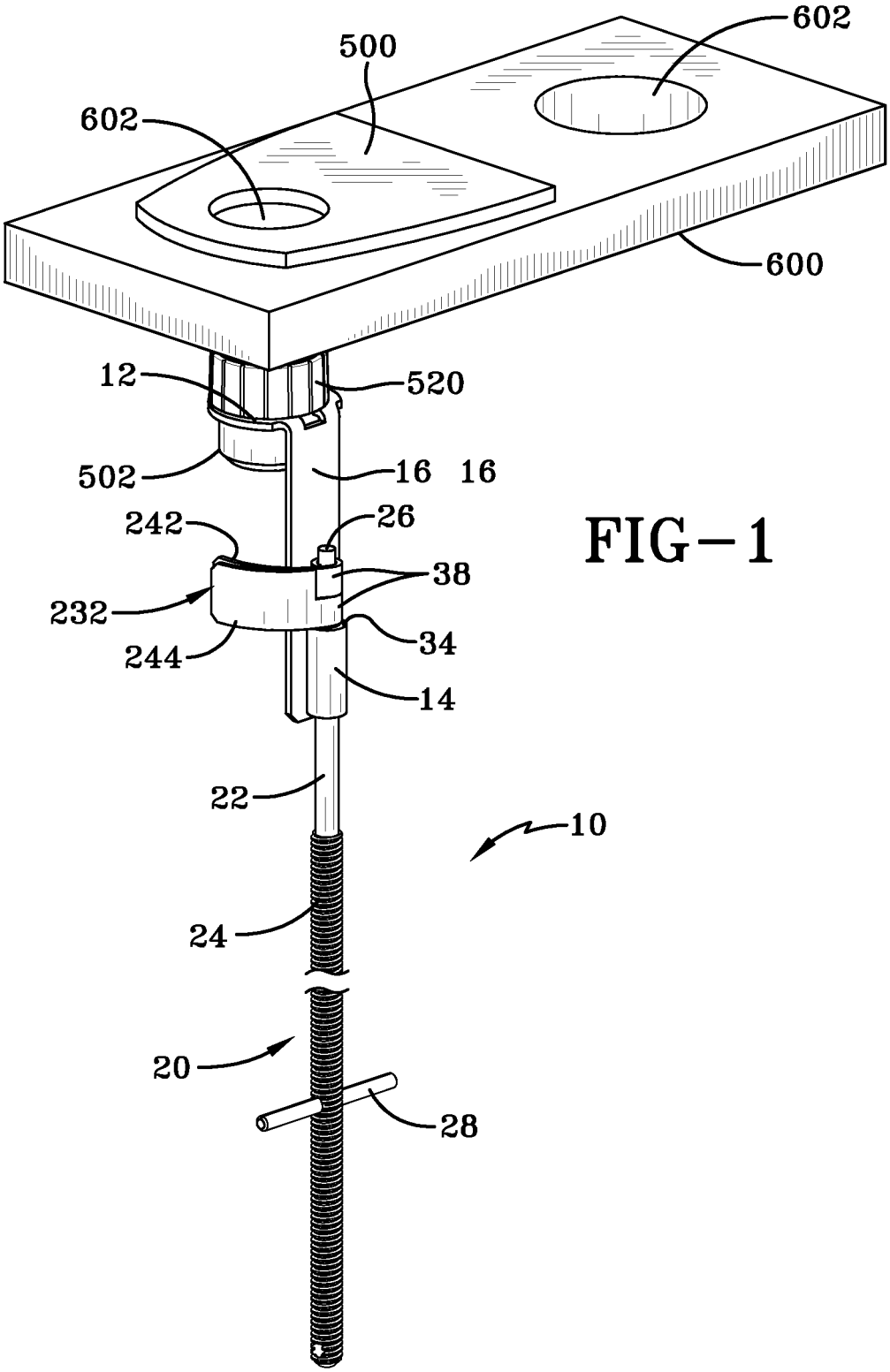
FIG. 1 is a perspective view of a first embodiment of a plumbing fixture mounting device, positioned under a countertop.

FIG. 1 is a perspective view of a first embodiment device 10 that is useful in mounting a plumbing fixture, especially a faucet, having a body 500 and an externally-threaded inlet tube 502. In FIG. 1, the body 500 is depicted schematically with the inlet tube 502 extending through a surface 600 having two holes 602. A typical surface 600 could be a counter top or a sink, but it could also be a vertical surface, such as a wall. Plumbing fixtures of this type will be known in the art and will typically have two such inlet tubes, such as inlet tube 502. The threading on the inlet tube 502 is sized to receive a standard connecting nut at an end of a supply tube (not shown in FIG. 1), which will connect the plumbing fixture to a supply of water or the like. Inlet tube 502 is also able to receive a threaded sleeve 520, one of which is shown in FIG. 1 positioned on the inlet tube, above a collar member 12 of the device 10. By omitting the supply line in FIG. 1, the device 10 is more readily seen, although it is shown in later figures, such as FIG. 2A.

The device 10 has a collar member 12 that is sized to be slidingly received on the inlet tube 502. When the connecting nut threadingly engaged on the inlet tube 502, the larger outside diameter of the nut retains the collar member on the inlet tube. An internally-threaded guide member 14 is shown in FIG. 1 as being connected to the collar member 12 by means of an elongate member 16, which positions the guide member axially below the collar member, although the guide member could be connected directly to the collar member in some embodiments. Also, the collar member 12 is depicted as integral to elongate member 16, but they could be separate pieces that are attached to each other.

Received in the guide member 14 is a rod assembly 20. The rod assembly comprises a rod 22, threaded externally along at least an intermediate portion 24. The threading is complementary to the internal threading of the guide member 14. In the FIG. 1 embodiment, the rod assembly 20 can slide axially upwardly (towards the surface 600) until the threaded portion 24 engages the threading of the guide member 14, at which point the threading engagement occurs. When engaged, the rod 22 has a longitudinal axis thereof arranged effectively parallel to a longitudinal axis of the inlet tube 502. The rod assembly 20 is provided at a first end with an enlarged stop or end cap 26. The rod assembly 20 may also be provided at a second end with a means 28 for assisting manual rotation of the rod assembly in the guide member 14. In the depicted embodiment, the means 28 is a pin that passes through the rod. A thumb screw would also be a suitable means.

The rod assembly also has a flag member 232, which is slidingly received on the rod 22 near the first end, where it is effectively restrained from axial movement, typically by way of the enlarged stop 26 and a means 34 placed immediately below the flag member 232. The flag member 232, in this embodiment, has a pair of bodies 242, 244 with a sleeve 38 along one side of each of the bodies. The sleeve 38 is the portion of the flag member 32 that is received on the rod 22.

The ability of the flag member 232 to rotate about the rod 22 provides the flag member with a stowed position, as shown in FIG. 1, and a deployed position, which is not shown in FIG. 1, but which will be disclosed below. In the stowed position, the bodies 242, 244 of the flag member 32 are generally aligned along the outside of the inlet tube 502, minimizing the profile of the device 10 in the axial direction and allowing an assembled unit comprising the inlet tube 502, the supply line (illustrated by its largest circumferential component, which is the connecting nut 550 seen in FIG. 2) and the device 10, to pass through one of the holes 602. By way of contrast, and as illustrated in a later figure, the deployed position of the flag member 232 increases the axial profile of the assembled unit and restricts axial movement upwardly through the hole 602. In some embodiments, a resilient detent may be provided to retain the flag member 32 in its deployed position.

Figure 2A:
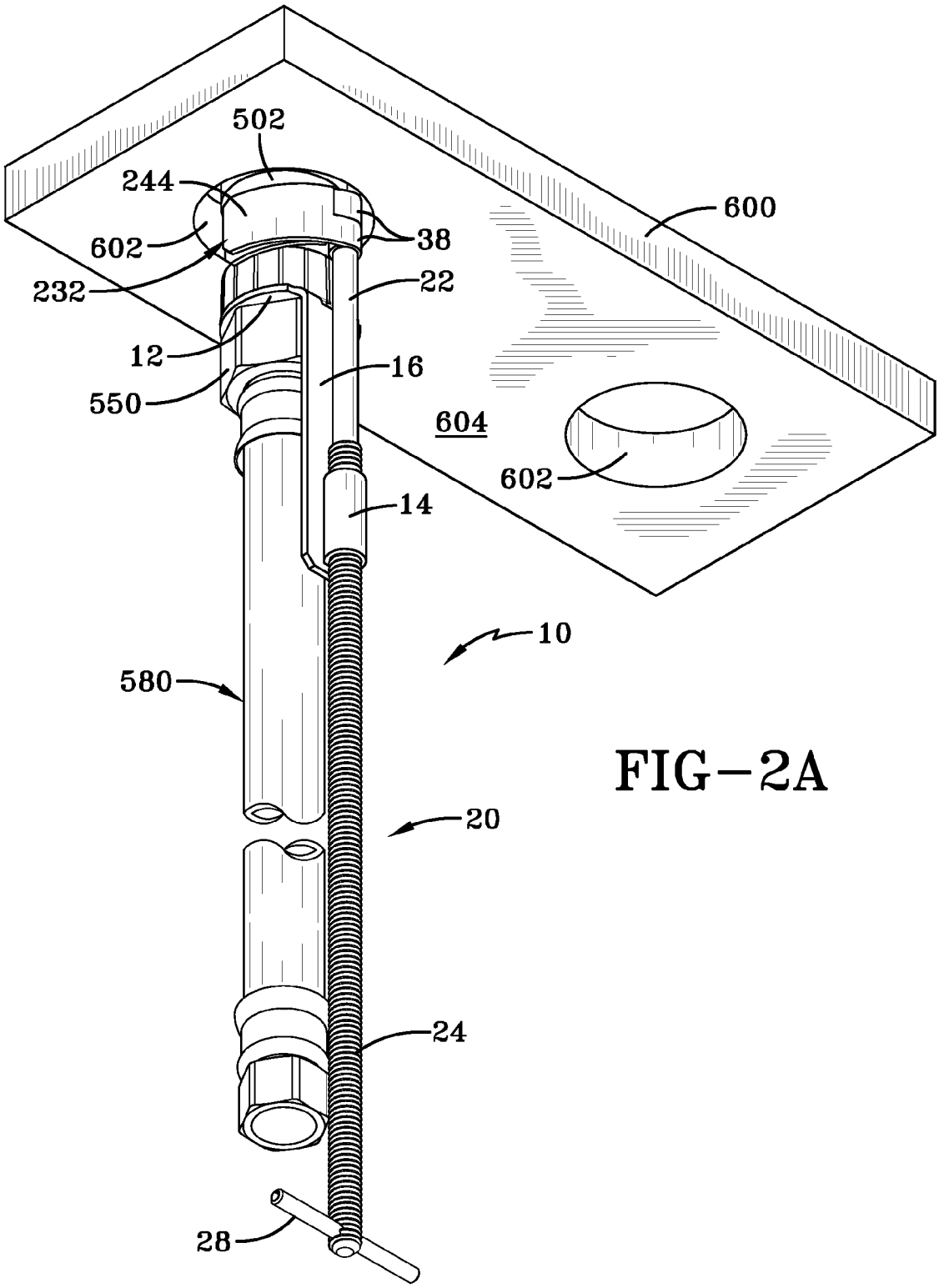
FIGS. 2A and 2B are bottom perspective views of the FIG. 1 device, showing the stowed and deployed positions thereof.
Figure 2B:
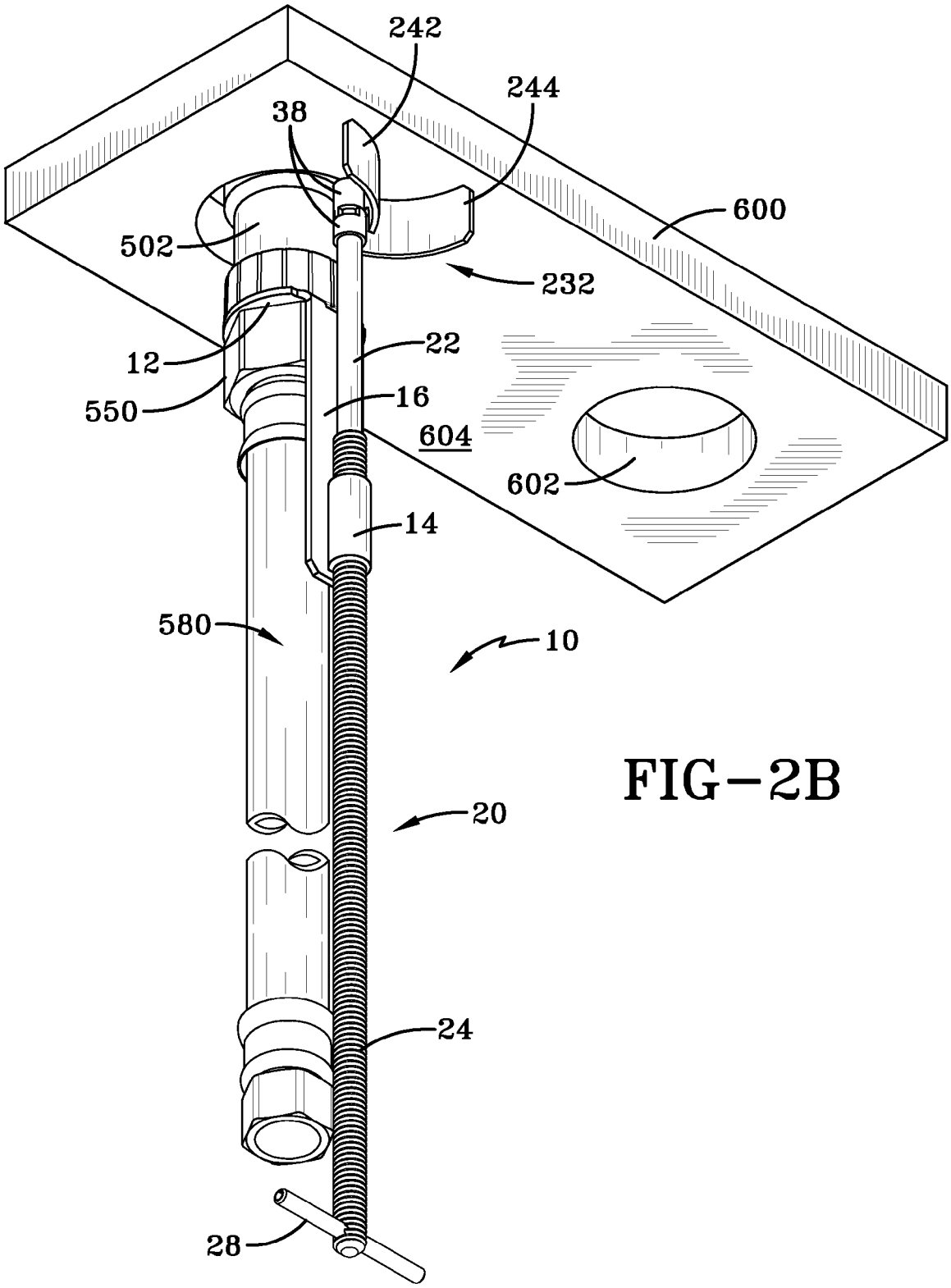

FIGS. 2A and 2B illustrate this movement of the flag member 232 between the stowed and deployed positions. In FIG. 2A, which is a perspective view looking upwardly at a lower face 604 of surface 600, which could represent a counter top, hole 602 is clearly seen. The bodies 242, 244 of flag member 232 are rotated into alignment along the inlet tube 502. In this position, the assembly of the inlet tube, supply line 580 along with connecting nut 550 and device 10 are able to pass through the hole 602 in the upward direction (toward surface 604). Supply line 580, as will be generally known in the industry, is typically a flexible hose. As shown in FIG. 2B, the rotation of the flag member bodies 242, 244 about the sleeve 38 into a position in which the bodies extend generally radially from rod 22, significantly increasing the axial profile of the assembled unit. If the rod 22 is advanced towards the lower face 604 so that the bodies 242, 244 are just below the face 604 and the flag member 232 is placed into the deployed position of FIG. 2B, upward axial movement of the assembled unit through hole 602 is prevented. The structure of the plumbing fixture body 500, as depicted schematically in FIG. 1, prevents downward axial movement at the same time. In this way, the plumbing fixture body 500 is effectively restrained from axial movement in either direction in hole 602.

Figure 3:
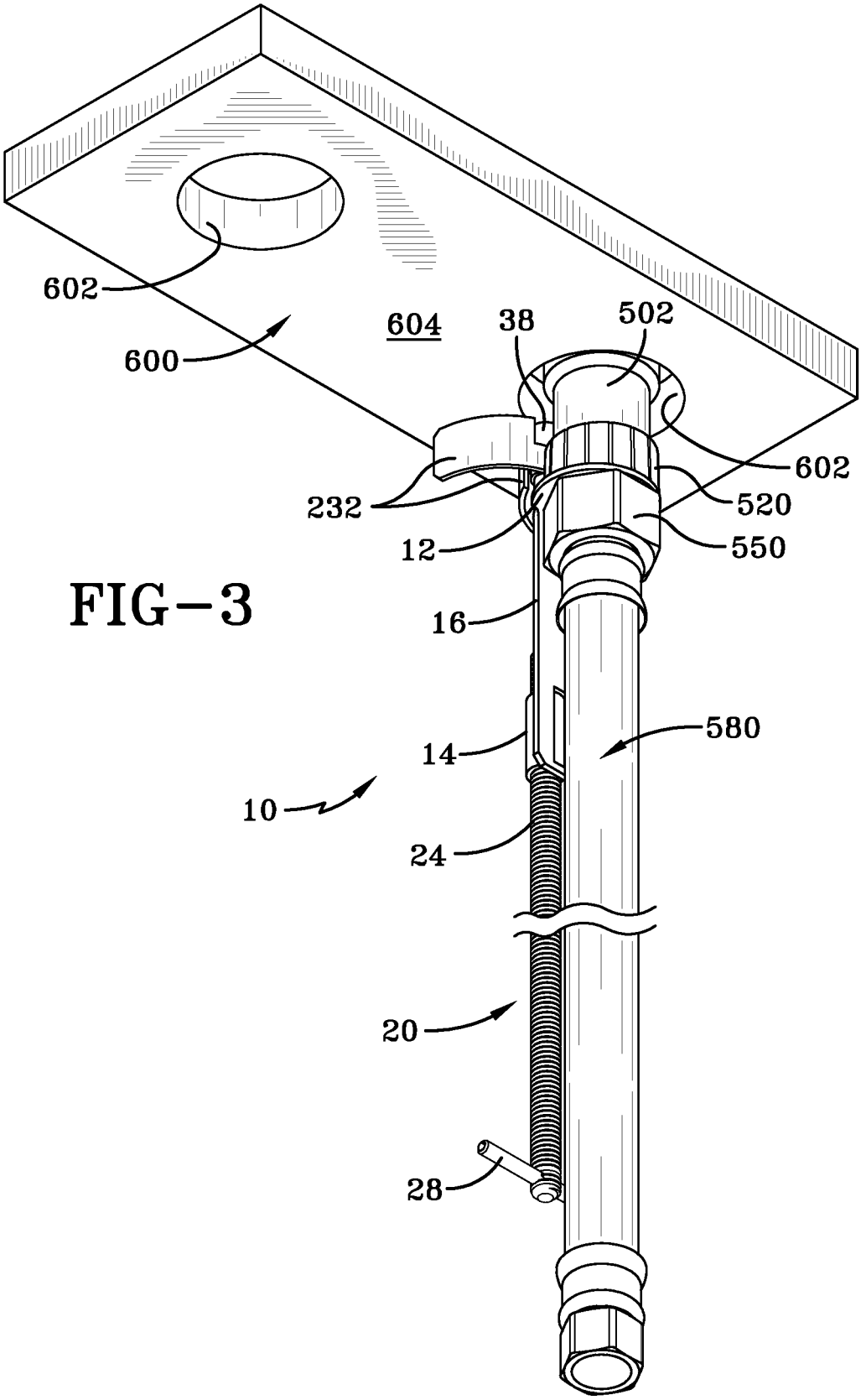
FIG. 3 is a further bottom perspective view of the FIG. 1 embodiment, positioned under a countertop in the deployed position.

In FIG. 3, the device 10 is depicted from a bottom perspective view, but from the rear instead of the front and with the flag member 232 in the deployed position, in which the flag member 232 prevents upward axial movement through the hole 602 by bearing against bottom surface 604.

Figure 4:
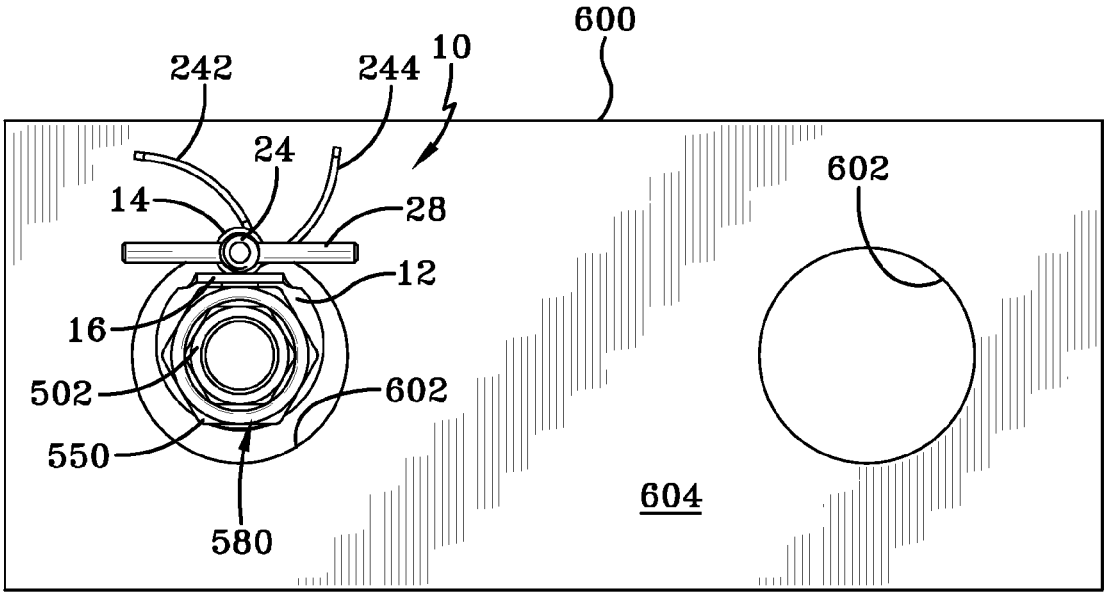
FIG. 4 is a bottom plan view of the FIG. 1 embodiment, showing the body members in the deployed position.

Some additional aspects are better seen in the plan view from below shown in FIG. 4. The body members 242, 244 are both rotated relative to the inlet tube and the hinged relation between the body members is opened. This provides two distinct bodies to bear against lower face 604. In a preferred version of this opened relationship, the body members 242, 244 are approximately perpendicular to each other where they intersect.

With this understanding of the device in hand, the use of the embodiment 10 can now be also described. The advantage of the embodiment 10 (as well as a further embodiment 210 described below) is to provide a method for mounting and connecting a plumbing fixture 128 having a body 500 on a first side of a surface 600 to a supply line 580 originating on a second side 604 of the surface through a hole 602 in the surface, in which the method allows the supply line and its associated connecting nut 550 to be passed through the hole from the second side to the first side and connected before lowering the body 500 into place. This is now taught, through use of the devices disclosed above.

Figure 5:
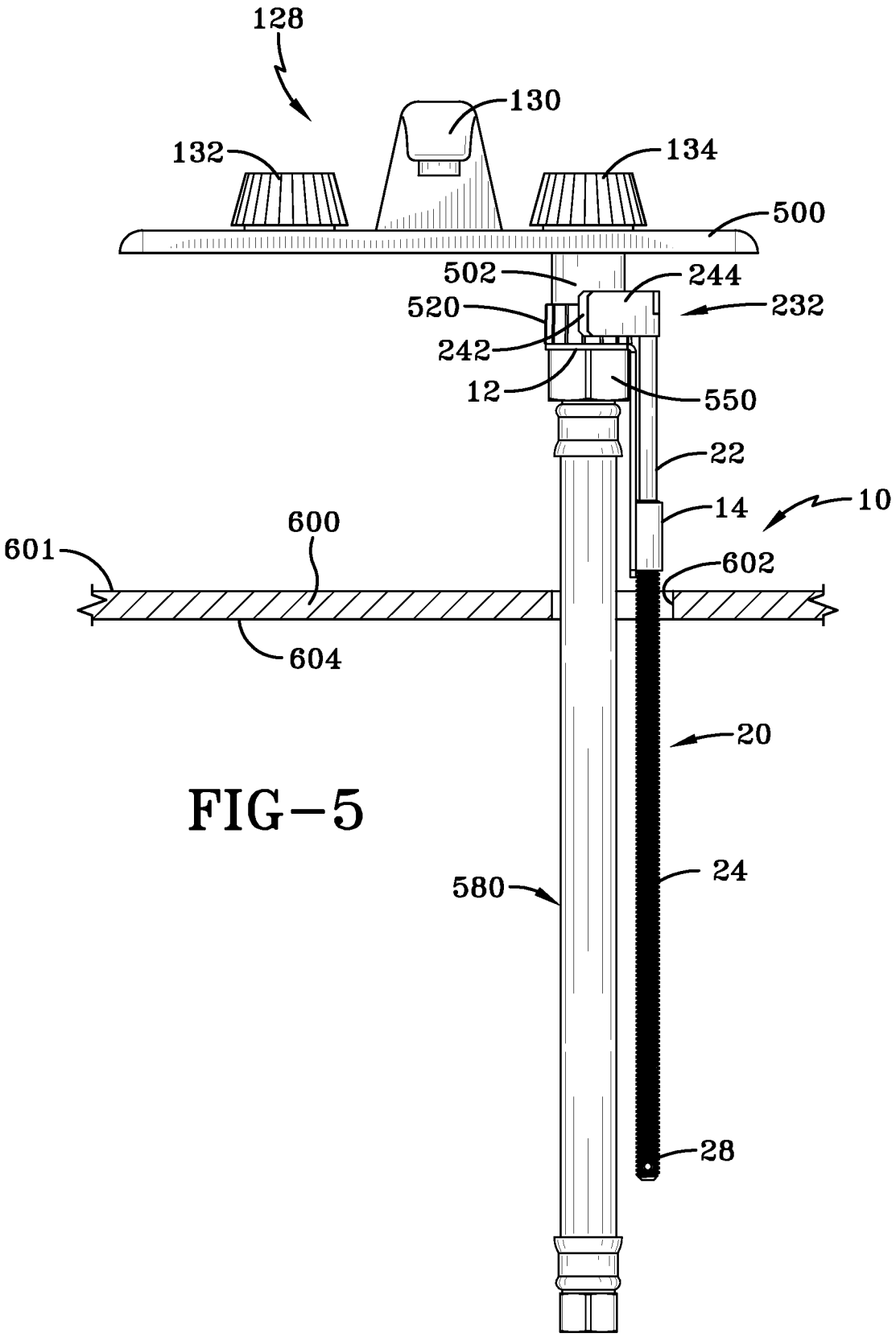
FIG. 5 is a front elevation view of an arrangement of a faucet and the FIG. 1 device, positioned for passage through a countertop.

As depicted in FIG. 5, and with a device such as one of the embodiments 10, the installer passes the connecting nut end of the supply line 580 through the hole 602 from the second side 604 of the surface to the first side. Using the embodiment 10 as exemplifying the operation of any of the embodiments taught herein, the installer also positions the mounting device 10 in the hole 602, especially with the collar member 12 being on the first side and the rotating means 28 of the rod being on the second side. By placing the collar member 12 onto the inlet tube 502, the installer can secure the device 10 on the inlet tube. In some aspects of the method, this is accomplished by securing the collar member 12 by engaging a threaded sleeve 520 onto the inlet tube 502. In some other aspects, the connecting nut 550 serves this purpose when it is connected to the inlet tube. By doing this, the installer has effectively formed a connected plumbing fixture which is partially on the first side 601 of the surface and partially on the second side 604 of the surface. The connected plumbing fixture comprises: the inlet tube 502 of the plumbing fixture; the device 10, with its collar member 12 on the inlet tube; and the supply line 580, with its connecting nut 550 engaged on the inlet tube to retain the collar member on the inlet tube. The means for securing the plumbing fixture in place relative to the hole 602, in this case the means being represented by flag member 232, is moved to a position that facilitates passage downwardly through the hole 602. In the case of flag member 232, this is the stowed position shown in FIG. 2A. Since the rod 22 and the guide member 14 are aligned in close parallel relationship to the supply line 580, the connected plumbing fixture can be passed down into the hole 602. When the inlet tube is fully lowered into the hole 602, the body 500 of the plumbing fixture will rest atop the hole and will prevent further axial movement of the connected plumbing fixture through the hole from the first side 601 of the surface toward the second side 604. In the depiction of FIG. 5, the fixture 128 and body 500 has a faucet 130 and a pair of knobs 132, 134, along with a single supply line 502. In other known embodiments, there may be two supply lines, in which case two holes 602 are provided. However, even in those embodiments, it may be likely that the fixture 500 may be secured properly using a device 10 on only one of the supply lines.

Figure 6:
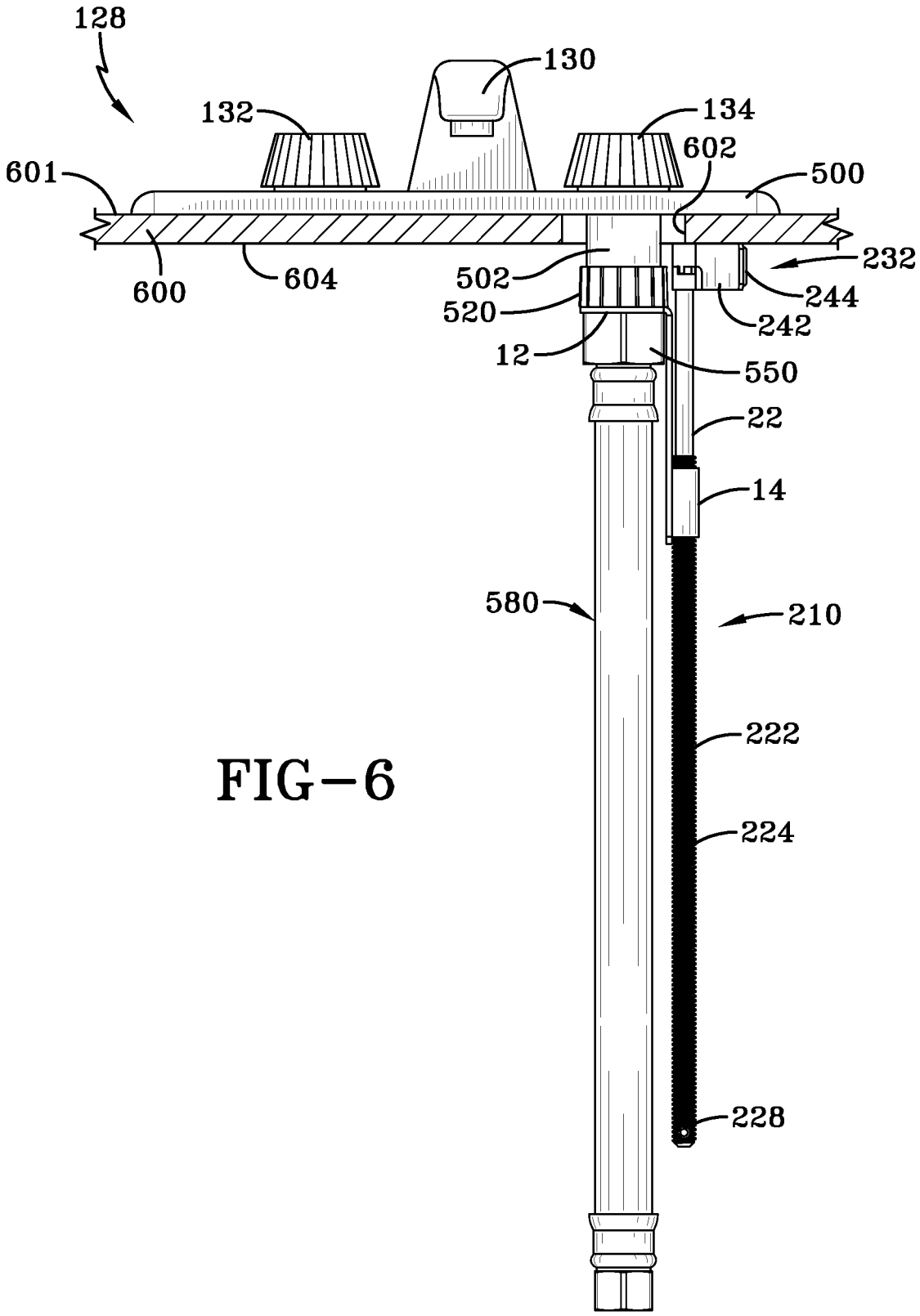
FIG. 6 is a front elevation view of the FIG. 5 arrangement, with the faucet and FIG. 1 device mounted on the countertop.

After being lowered into place, then, the situation is as seen in FIG. 6, which is a further elevation view showing the installation process. By turning the rod 22 in a direction that advances it in the guide member towards the bottom surface 604 of the counter 600, the flag member will approach the bottom surface. As it nears, the flag member 232 is moved to the deployed position, at which time, as depicted, it will bear directly against the bottom surface 601. This prevents the axial movement of the connected plumbing fixture 500 in a direction from the second side 604 to the first side 601. In other words, the plumbing fixture body 500 and the flag member 232 co-act to secure the connected plumbing fixture in the hole 602 and the action of advancing the rod 22 through the guide member 14 towards the bottom surface 604 is accomplished much more readily than the methods available in the prior art. Of course, to remove the connected plumbing fixture 500, the process may be reversed, with the removal of the supply line connecting nut 550 from the inlet tube 502 being accomplished above the surface, that is, on the first side 601.

Figure 7:
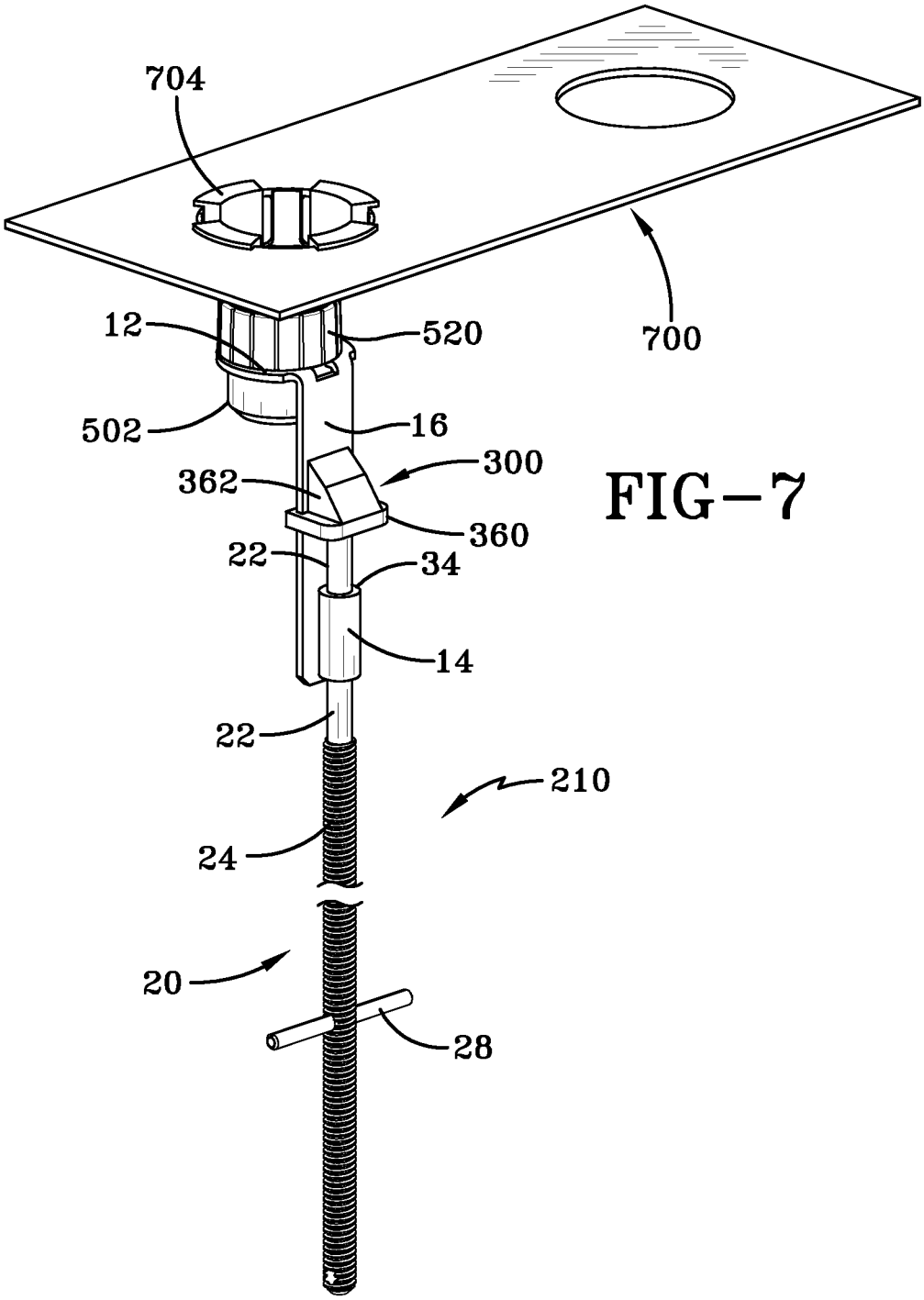
FIG. 7 is a perspective view of a second embodiment of the plumbing fixture mounting device, as used to install the plumbing fixture in a thin surface, such as a stainless steel sink.

A further embodiment 210 of the invention is presented in FIG. 7. It will be understood from the description provided that the concept of lowering a plumbing fixture through the counter top while the supply lines (or lines) are already attached is maintained in this further embodiment and that the difference in the embodiment lies primarily in the manner in which the plumbing fixture is held in place. In FIG. 7, a slightly different situation is provided for the surface 700 that is used for the mounting. Here, a thin surface 700 is depicted, such as would be provided by a stainless steel sink. Holes 702 provide very little depth, so it may be useful to insert a cylindrical insert 704 as is shown in one of the holes 702. The device 210 has a collar member 12 that is sized to be slidingly received on the inlet tube, which is not shown in FIG. 7, as this has been previously taught above. A threaded sleeve 520, which is not otherwise connected to the device 210 is shown above collar member 12. Another sleeve 520 could also be used below the collar member 12 instead of the connecting nut 550 in the manner in which it would hold the device on an inlet tube. The internally-threaded guide member 14 is, as in FIG. 1, connected to the collar member 12 by means of an elongate member 16, which positions the guide member axially below the collar member, although the guide member could be connected directly to the collar member in some embodiments. Also, the collar member 12 is depicted as integral to elongate member 16, but they could be separate pieces that are attached to each other.

Received in the guide member 14 is a rod assembly 20. The rod assembly comprises a rod 22, threaded externally along at least an intermediate portion 24. The threading is complementary to the internal threading of the guide member 14. In this embodiment, the rod assembly 20 can slide axially upwardly until the threaded portion 24 engages the threading of the guide member 14, at which point the threading engagement occurs. When engaged, the rod 22 has a longitudinal axis thereof arranged effectively parallel to a longitudinal axis of the inlet tube. At a first end of the rod assembly 20 is the means for securing the device into a hole, as in hole 602 of FIGS. 5 and 6. The securing means 300 is shown as two parts, but they co-act and could be a single part. The first of these is a tracking member 360, which is characterized by a pair of tracks or channels that slidingly engage the sides of elongate member 16. Tracking member 360 is attached to the top end of rod 22 in a manner that allows the rod to rotate while the tracking member moves only axially up or down. Atop the tracking member 360 is the second part of the securing means. This second part is a wedge member 362, which is integral with or affixed to the tracking means 360 on the surface opposite the attachment to rod 22. Wedge member 362 is preferably made of a resilient material, such as cross-linked elastomer. Instead of engaging the bottom surface of the counter or sink, this wedge member 362 co-acts with the rigid inlet tube 502 to frictionally engage, by a wedging action, the hole 702, preventing axial upward movement of the inlet tube.

Figure 8:
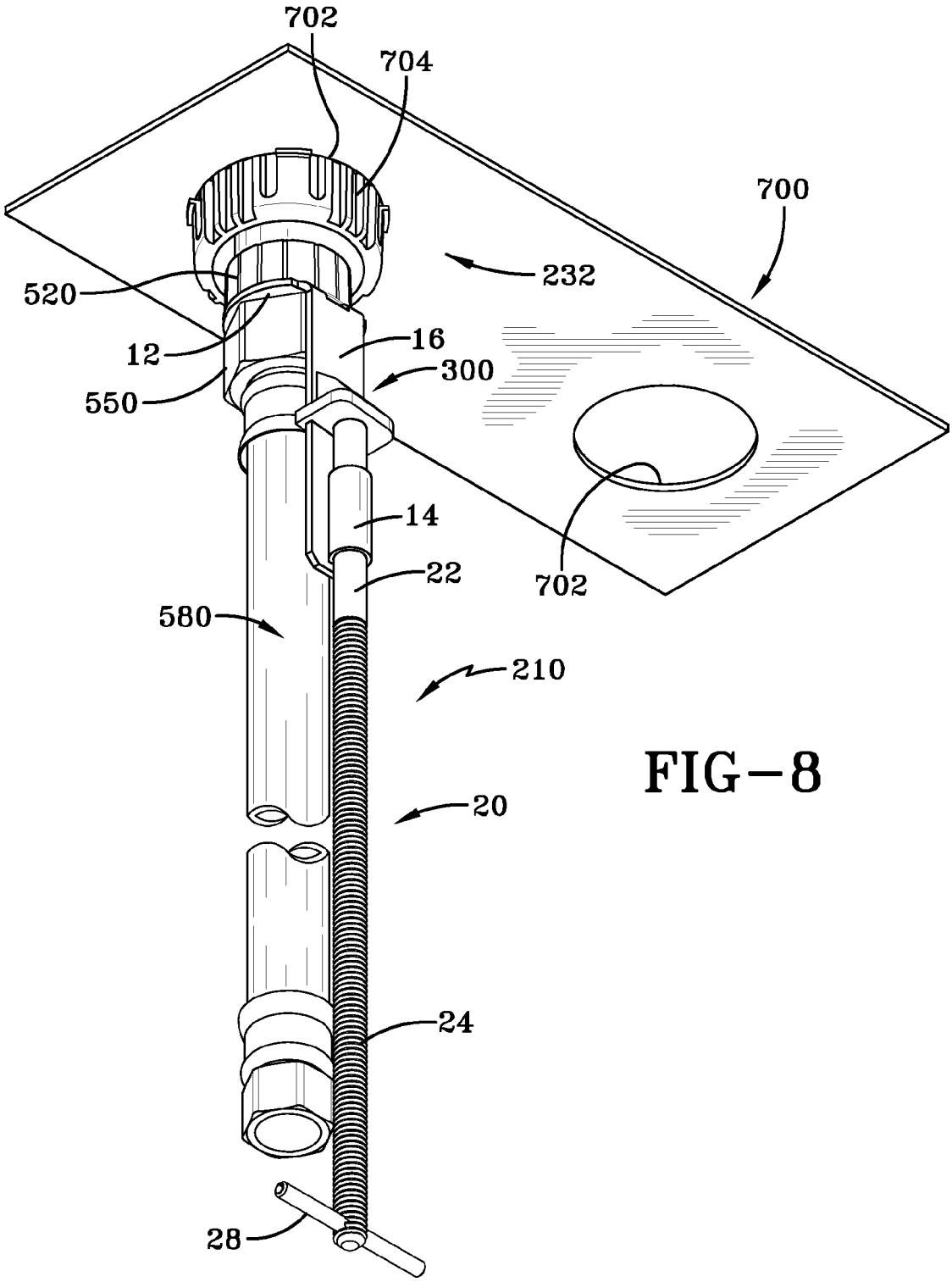
FIG. 8 is a bottom perspective view, similar to FIG. 2A, showing the FIG. 7 embodiment.

FIG. 8 provides a bottom perspective view, similar to FIG. 2A, but showing the FIG. 7 embodiment 210 in use in association with the thin surface 700 and an insert 704. In this Figure, the securing means 300 is in the deployed position, in that it is not engaging the insert 704.

Figure 9:
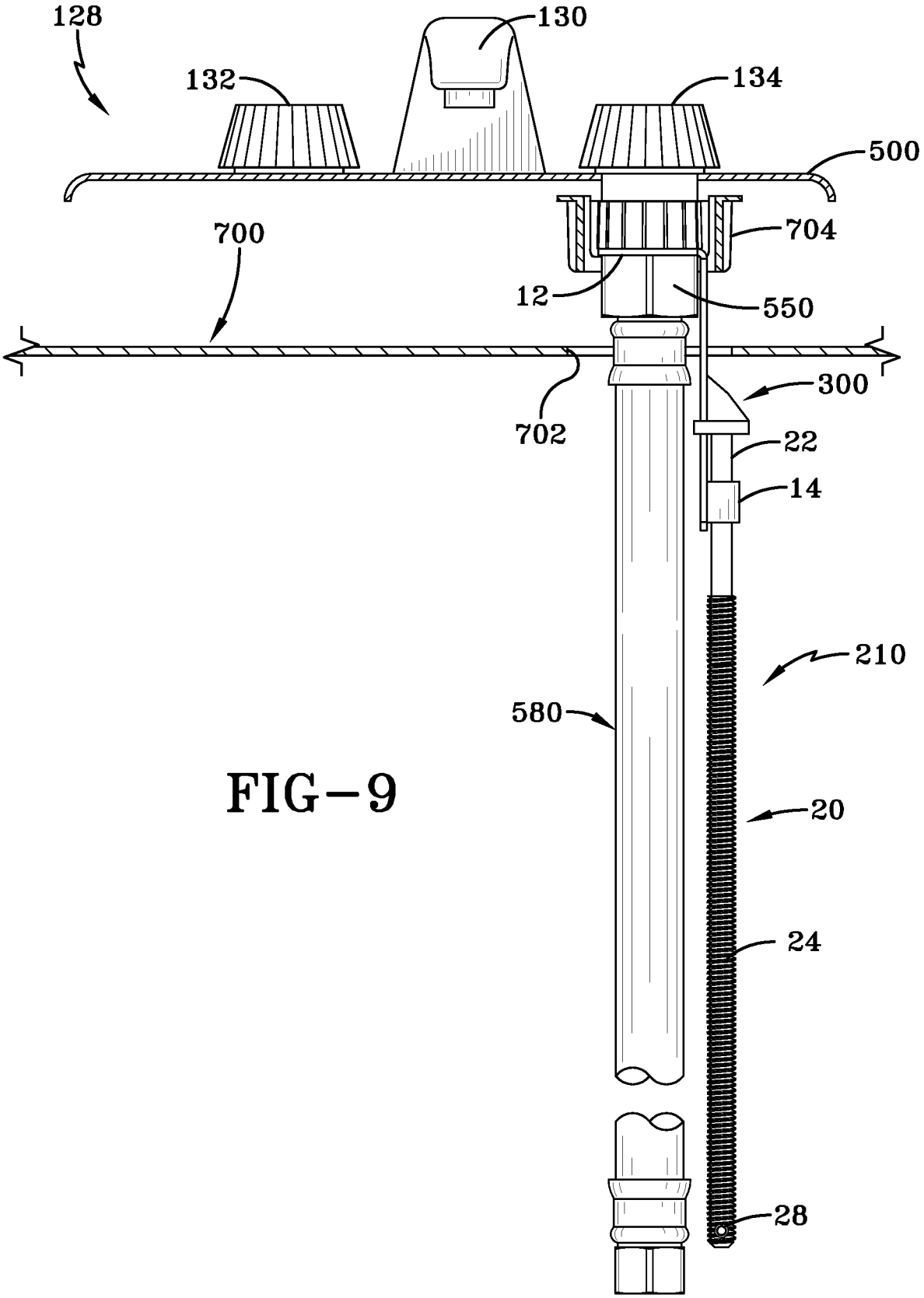
FIGS. 9 and 10 are front elevation views of the FIG. 7 embodiment being used in the same manner as in FIGS. 5 and 6, but in a thin surface.
Figure 10:
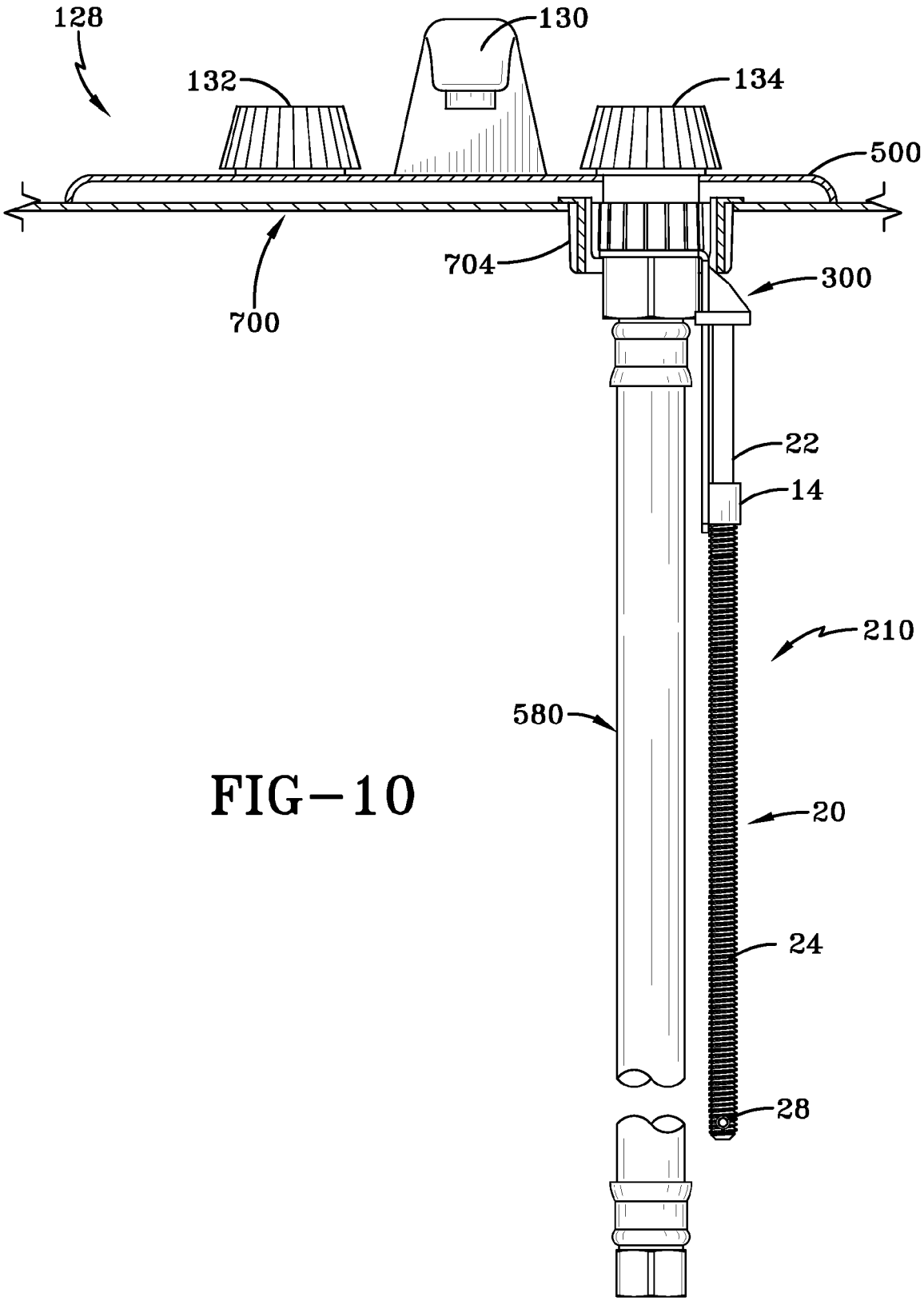

FIGS. 9 and 10 are front elevation views of the FIG. 7 device 210 being used in the same manner as the first embodiment is used in FIGS. 5 and 6. However, the installation is shown using the thin surface 700 and an insert 704 in hole 702.

Figure 11:
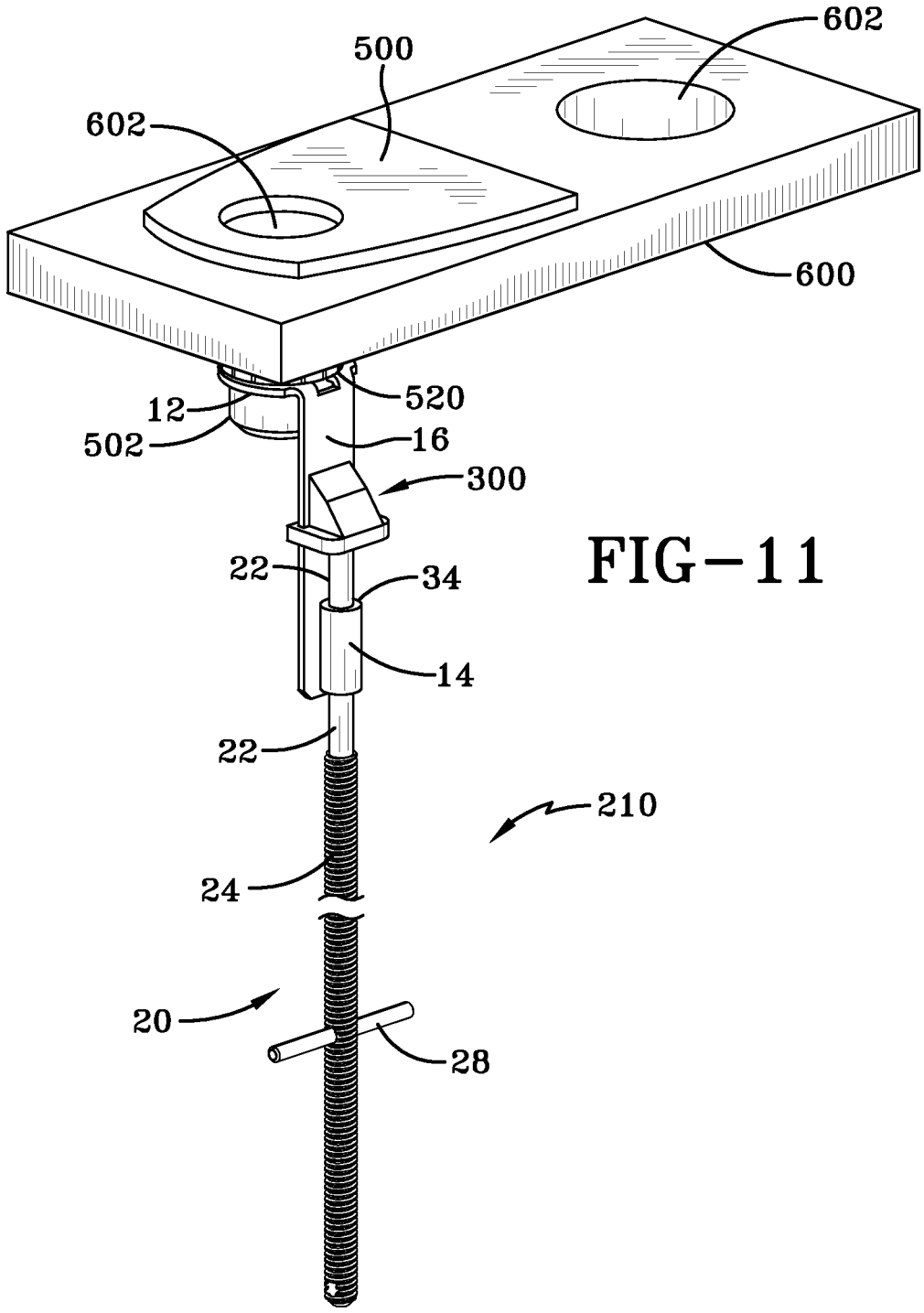
FIG. 11 is a perspective view of the FIG. 7 embodiment for installing a plumbing fixture in a countertop of the type in FIG. 1.

FIG. 11 is a perspective view of the FIG. 7 device 210 for installing a plumbing fixture 500 in a counter top 600 of the type shown in FIG. 1.

Figure 12:
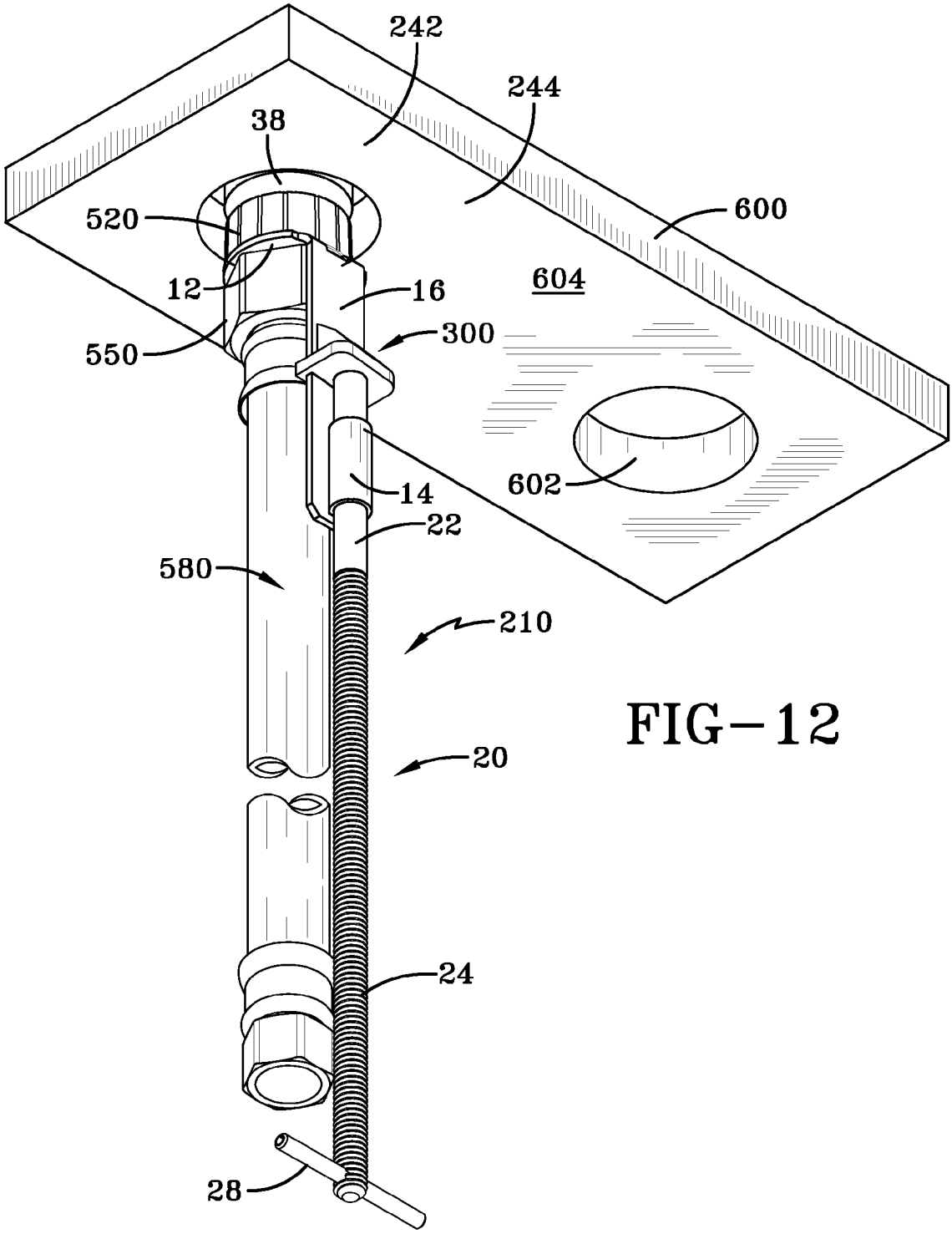
FIG. 12 is a bottom perspective view, similar to FIG. 2A, of the FIG. 7 embodiment being used in the countertop.

FIG. 12 is a bottom perspective view, similar to FIG. 2A, of the FIG. 7 device 210 being used in the counter top 600.

Figure 13:
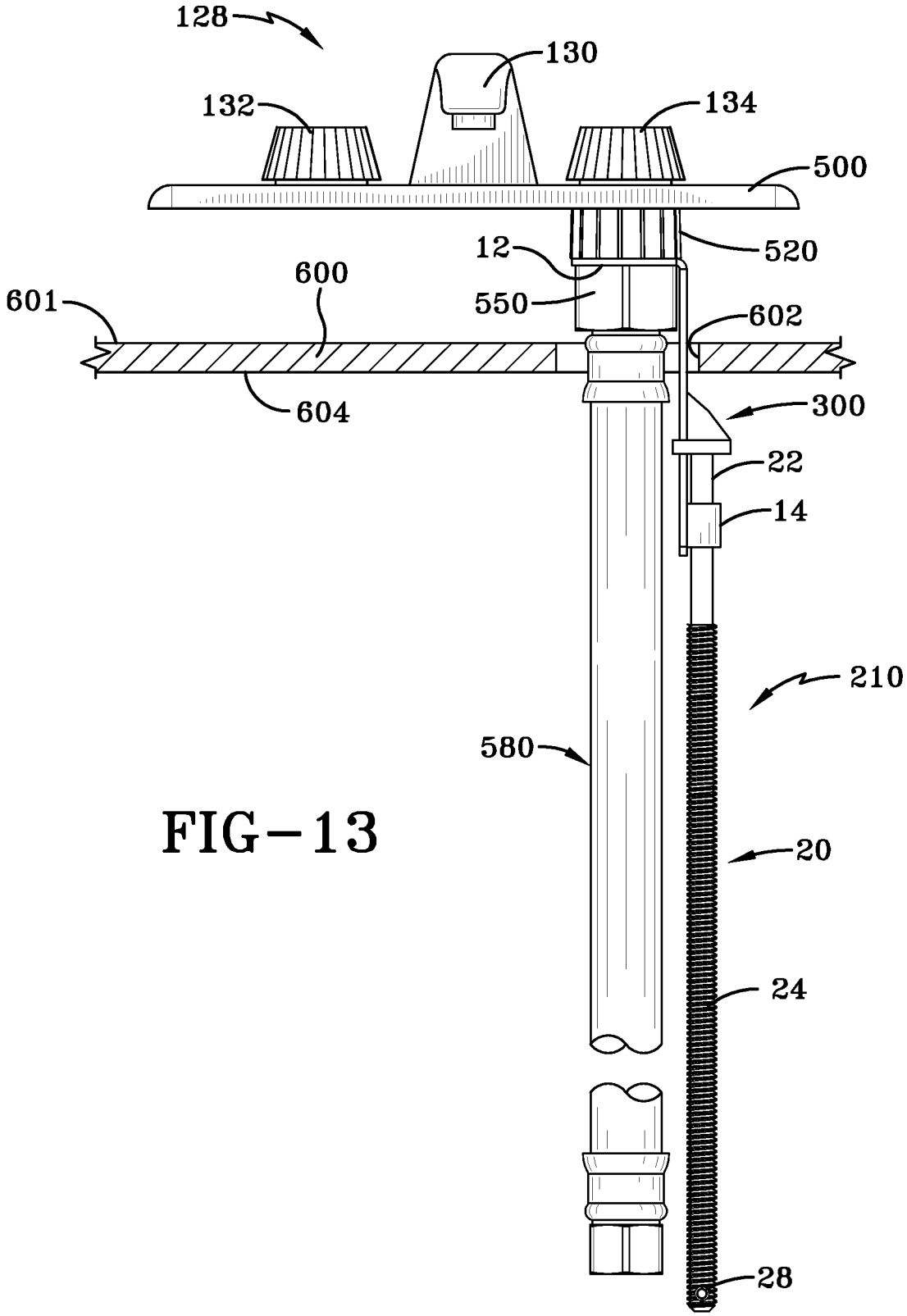
FIGS. 13 and 14 are front elevation views of the FIG. 7 embodiment being used in the same manner as in FIGS. 9 and 10, but in the countertop.
Figure 14:
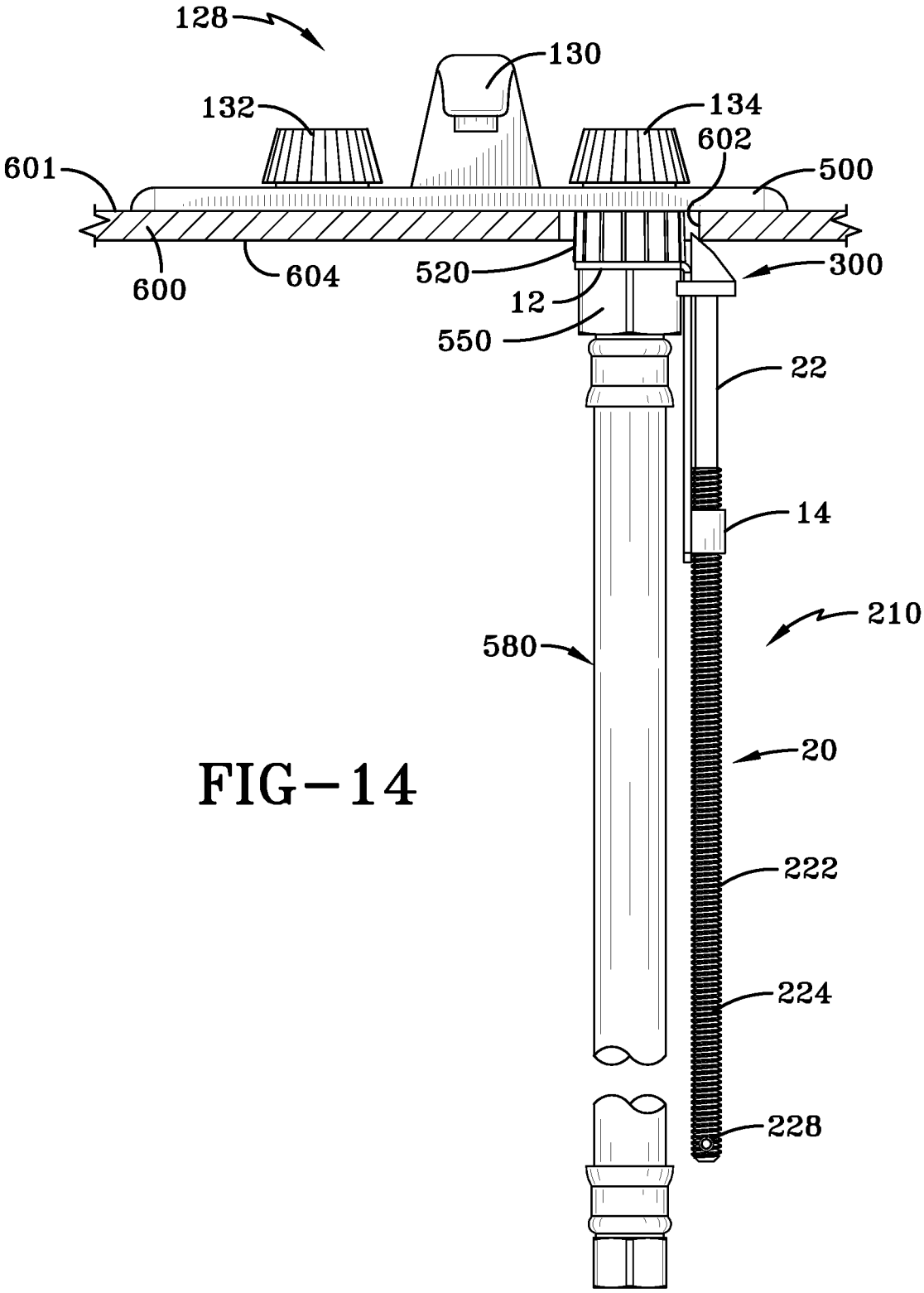

FIGS. 13 and 14 are front elevation views of the FIG. 7 embodiment being used in the same manner as in FIGS. 9 and 10, but in the countertop.

What is claimed is:

1. A device for mounting a plumbing fixture on a surface, the plumbing fixture having a body with at least one externally-threaded inlet tube for connection to an end of a supply line having a threaded connecting nut, and the surface having at least one hole, each of which is arranged for insertion of a corresponding one of the inlet tubes therethrough, the device comprising:

an elongate member, having first and second ends;

a collar member, attached to or integral with the first end of the elongate member, the collar member having an aperture sized to be slidingly received on one of the at least one inlet tubes;

a guide member, open at both ends and internally threaded, attached to or integral with the collar member at or near the second end of the elongate member;

a rod, externally threaded along at least part of the length thereof for rotating engagement in the guide member with a first end of the rod extending from the first open end of the guide member and a second end of the rod extending from the second open end; and a means for retaining the inlet tube in the hole, positioned at a first end of the rod.

2. The device of claim 1, wherein:

the retaining means comprises a wedge member, rotatingly attached to the first end of the rod.

3. The device of claim 2, further comprising:

a means for tracking the wedge member in a non-rotating manner in an axial direction of the elongate member.

4. The device of claim 2, further comprising:

a means for assisting manual rotation of the rod in the guide member, positioned near the second end of the rod.

5. The device of claim 4, wherein:

the means for assisting manual rotation comprises a bar passing radially through the rod.

6. The device of claim 2, wherein:

the wedge member comprises a resilient elastomer.

7. The device of claim 1, wherein:

the retaining means comprises a flag member, attached to the first end of the rod for selective rotation between a stowed position and a deployed position.

8. The device of claim 7, further comprising:

a means for assisting manual rotation of the rod in the guide member, positioned near the second end of the rod.

9. The device of claim 8, wherein:

the means for assisting manual rotation comprises a bar passing radially through the rod.

10. The device of claim 7, wherein:

the flag member comprises a generally rectangular section of an annular ring with a radius of curvature that proximates the radius of the inlet tube, allowing the flag member to align closely with the inlet tube when in the stowed position.

11. The device of claim 7, wherein:

the body of the flag member comprises a first and a second body member, hingedly connected to each other along a side of each, with the body members in closed hinged relation to each other in the stowed position and in open hinged relation to each other in the deployed position.

12. The device of claim 11, wherein:

in the deployed position, the first and second body members are perpendicular to each other about the hinge.

13. A method for mounting and connecting a plumbing fixture on a first side of a surface to a supply line on a second side of the surface through a hole in the surface, the plumbing fixture comprising a fixture body with an inlet tube sized and adapted for threading engagement to a connecting nut at an end of the supply line, the method comprising the steps of:

placing the plumbing fixture on the first side of the surface;

positioning a mounting device according to claim 1with the hole in the surface, with the collar member on the first side of the surface and the second end of the rod on the second side of the surface;

passing the connecting nut end of the supply line through the hole from the second side of the surface to the first side;

engaging the connecting nut to the inlet tube, after the collar member of the mounting device is positioned on the inlet tube, retaining the collar member thereon and forming a connected plumbing fixture;

passing the inlet line of the connected plumbing fixture through the hole from the first side to the second side; and securing the connected plumbing fixture to the surface from the second side by using the retaining means of the mounting device.

* * * * *